US005499622A

United States Patent [19]

Woods

[11] Patent Number: 5,499,622

[45] Date of Patent: Mar. 19, 1996

[54] AFTERBURNER SYSTEM AND PROCESS

[76] Inventor: Maurice G. Woods, 1533 Glenbrook, Oklahoma City, Okla. 73118

[21] Appl. No.: 375,952

[22] Filed: Jan. 20, 1995

[51] Int. Cl.[6] ..... F24B 1/18

[52] U.S. Cl. ..... 126/500; 126/521; 126/83; 110/211; 110/345

[58] Field of Search ..... 126/521, 522, 126/77, 83, 108, 500; 110/203, 210, 211, 212, 213, 214, 250, 345

[56] References Cited

U.S. PATENT DOCUMENTS

| | | | |
|---|---|---|---|
| 3,496,890 | 2/1970 | La Rue | 110/210 |
| 4,422,437 | 12/1983 | Hirschey | 126/77 |
| 4,425,305 | 1/1984 | Retallick | 126/77 X |
| 4,434,782 | 3/1984 | Traeger | 126/77 |
| 5,007,404 | 4/1991 | Hall et al. | 126/77 |
| 5,062,411 | 11/1991 | Karabin et al. | 126/521 X |
| 5,199,362 | 4/1993 | Carter | 110/211 |
| 5,263,471 | 11/1993 | Shimek et al. | 126/77 X |
| 5,284,102 | 2/1994 | Thomason | 110/210 |
| 5,317,980 | 6/1994 | Bono Coraggioso | 110/211 X |
| 5,413,089 | 5/1995 | Andors et al. | 110/210 X |

*Primary Examiner*—Larry Jones
*Attorney, Agent, or Firm*—William D. Jackson; Harris, Tucker & Hardin

[57] ABSTRACT

Process and system for the operation of a fireplace or the like in which combustion products including pollutant gases and entrained particulate materials are treated to substantially reduce pollutant levels. The combustion products are passed through a confined flue passageway, such as found in a chimney stack, which extends upwardly to the exterior of the dwelling house or other structure. The flow of combustion products is interrupted in a manner to cause the products to follow a tortuous path in which entrained particulates in the combustion products are separated so that they collect in a suitable disposal zone. The combustion products then pass into an afterburner section comprising a plurality of heating elements. The temperature of the combustion products is sensed below the afterburner section and above bank of heating elements. The heating elements are activated when the temperature at the lower location reaches a specified value and the combustion products are heated to a temperature sufficient to convert substantial quantities of carbon monoxide to carbon dioxide. When the temperature at the upper location reaches a specified upper value at least some of the heating elements are deenergized. A baffle system is interposed between the heating element bank and fireplace to deflect the flow of combustion products from a vertical flow path in a manner to extract particulate materials from the combustion products. The baffle system incorporates a primary deflecting member and a secondary deflecting member which extends downwardly from the primary deflecting member.

26 Claims, 4 Drawing Sheets

AFTERBURNER SYSTEM AND PROCESS

FIELD OF THE INVENTION

This invention relates to heating systems incorporating afterburners to reduce pollutants released into the atmosphere and more particularly, to such processes and systems for use in conjunction with heating units such as fireplaces, wood burning stoves and the like, which release combustion products directly into the atmosphere through chimney stacks.

BACKGROUND OF THE INVENTION

Primary combustion units such as fireplaces, wood burning stoves, or wood or coal burning furnaces have many advantages for use in remote locations or in aesthetic accouterments in dwelling houses, but they suffer the disadvantage that they can lead to serious pollution and environmental problems. For example, wood burning fireplaces, although aesthetically pleasing in many respects, are associated with severe heat loss problems, much of the heat goes "up the chimney" and more importantly, serious emissions problems are associated with the release of pollutants into the atmosphere. Typically, heating units such as stoves and fireplaces release substantial quantities of carbon monoxide, hydrocarbons and other organic pollutants and particulate materials such as ash and partially combusted cinders into the atmosphere.

Various systems have been proposed to reduce the quantitative pollutants released into the atmosphere, many of which involve the use of some sort of secondary afterburner system in which conversion of pollutants to less harmful products, e.g. carbon monoxide to carbon dioxide occur through oxidation, direct pyrolysis or catalytic conversion over simple catalyst materials. For example, U.S. Pat. No. 5,007,404 to Hall et al discloses a secondary combustion chamber for a wood stove in which preheated secondary combustion air is forced into the secondary chamber in the flue passage from a wood stove. The Hall system includes a forced air fan which blows air over a heating element in response to the measured temperature of combustion gases flowing from the primary combustion chamber through an opening into the secondary combustion chamber. Glow plugs are located in the secondary combustion chamber and a control circuit activates ignitor circuits for the glow plug. The fan is temperature controlled, for example, it may be turned on at about 700° F. and turned off at about 1200° F.

U.S. Pat. No. 4,422,437 to Hirschey discloses a system incorporating a fire box which functions as a primary combustion chamber. A horizontal baffle is interposed between the primary combustion chamber and a secondary chamber in which a forward afterburner chamber is separated from a rearward flue gas and by-pass chamber by means of intermediate partitions. Here, fresh air is supplied over catalytic grid type combusters and mixed with heated unburned flue gases to enable combustion of the flue gases as they move past the catalytic combuster tubes.

U.S. Pat. No. 4,434,782 to Traeger discloses a wood burning furnace in which hot combustion products from the fire box flow through a restricted fire box collar in an indirect heat exchange relationship with a heat exchanger. The heat exchanger includes electrically powered heating coils over which air is forced by a blower.

U.S. Pat. No. 5,263,471 to Shimek et al discloses a wood burning combustion chamber in which temperature is raised in the upper portion to pyrolytic temperature conditions which substantially consumes volatile combustible materials as they flow through a relatively narrow exhaust passageway into a chimney stack. Refractory insulation material is heated to pyrolytic temperatures so that radiant heat is transmitted through a glass door thus heating remote areas of the dwelling unit or other structure to be heated. Yet another system for disposing of creosote products is disclosed in U.S. Pat. No. 4,425,305. Here, catalytic material is coated on heating tubes through which combustion products pass from a stove into a chimney stack.

SUMMARY OF THE INVENTION

In accordance with the present invention, there is provided a novel process for the operation of a heating source such as a fireplace or the like located within a structure in which gaseous combustion products including water, carbon dioxide, carbon monoxide, oxygen and entrained particulate materials are treated to substantially reduce pollutant levels therein. In carrying out the invention, the combustion products from the primary combustion chamber are passed through a confined flue passageway, such as found in a chimney stack or the like, which extends upwardly from the primary combustion chamber to the exterior of the dwelling house or other structure. The flow of combustion products through the flue passageway is interrupted in a manner to cause the combustion products to follow a tortuous path in which entrained particulates in the combustion products are separated so that they collect in a suitable disposal zone. The combustion products are thereafter passed into an afterburner section which incorporates a heating bank comprising a plurality of heating elements. The temperature of the combustion products is sensed in at least two locations, the first is below the afterburner section and the second is above bank of heating elements, preferably in relatively close proximity thereto. The heating elements are activated when the temperature at the lower location reaches a specified value in excess of ambient temperature conditions, typically, about 25°–50° F. above ambient room temperature conditions of about 75° F. The combustion products are heated by the temperature heating elements to a temperature sufficient to convert substantial quantities of carbon monoxide in the combustion products to carbon dioxide. When the temperature at the second location above the heating element bank reaches a specified value above that required for conversion of carbon monoxide to carbon dioxide, e.g. a temperature within the range 1100°–1500° F., at least some of the heating elements are deenergized. Preferably, the heating elements are arranged in a plurality of subsets with the several subsets being activated sequentially at time intervals of about 5 seconds or more and more preferably, time intervals of at least 10 seconds. The residence time of the combustion products within the heating bank preferably is within the range of 0.5–2.0 seconds.

A further aspect of the invention involves a heating system for use in providing heat within the interior of a structure which comprises a primary combustion chamber and a chimney structure extending from the primary combustion chamber to provide an upwardly extending flue passageway. A bank of heating elements is disposed in the flue passage above the primary combustion chamber and first and second temperature sensors are located below and above the heating bank, respectively. A baffle system is interposed between the heating element bank and the primary combustion chamber to deflect the flow of combustion products from a vertical flow path in a manner to extract particulate materials from the combustion products. The heating apparatus further incorporates a control system for the heating elements which is responsive to signals from the first and second temperature sensors to control the operation of the heating elements. The baffle system preferably is interposed between the bank of heating elements and the lower temperature sensor and incorporates a primary deflecting member which extends transversely throughout the cross-sectional area of the flue passage. This deflecting member deflects combustion products laterally and outwardly above the periphery of the flow passage. The baffle further comprises a secondary deflecting member which extends downwardly from the primary deflecting member to direct the lateral flow of combustion products downwardly and then upwardly to return to a vertical flow configuration through the heating elements.

In yet a further aspect of the invention, there is provided a secondary afterburner system for reducing the pollutant level of combustion products which incorporates a baffle system especially adapted for the removal of particulate pollutants. The system comprises a combustion unit enclosure having an interior afterburner chamber in the upper portion thereof and a debris floor in the lower portion thereof. The unit is provided with a lower inlet and an upper outlet in fluid communication with the afterburner chamber which are adapted for insertion into the flue passage of a chimney structure. A conduit in the inlet extends into the interior of the combustion unit enclosure. A baffle system within the combustion unit enclosure provides a tortuous flow passageway between the outlet of the conduit and the afterburner chamber. The baffle system is configured to provide a lateral passage leading to downward flow passage of greater cross-sectional area than the inlet conduit and a second lateral flow passage which leads to an upper flow passage opening into the afterburner chamber. This upper flow passage has a greater cross sectional area than the downward flow passage. Preferably, the second lateral passageway has a cross sectional area intermediate those of the downward flow passage and the upward flow passage.

DETAILED DESCRIPTION OF THE INVENTION

Figure 1:
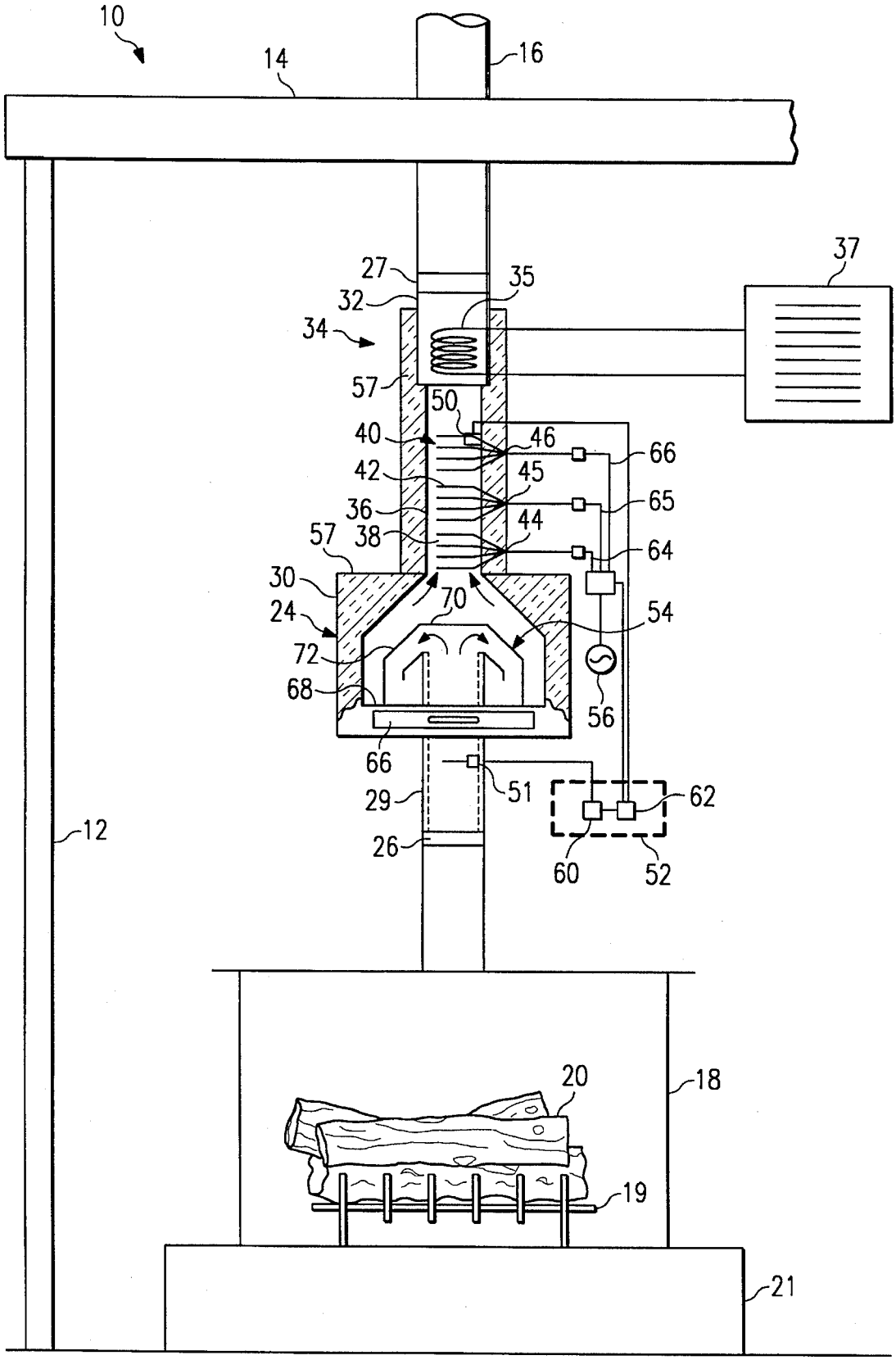
FIG. 1 is a schematic illustration of the present invention installed in combination with a fireplace such as might be encountered in a dwelling unit.

The present invention provides a method and apparatus for reducing pollutant emissions and minimizing heat losses as involved in heating systems in which fuel is burned to provide a primary heat source for dwelling units and similar structures. The invention is particularly well suited for use in conjunction with conventional fireplaces in which wood logs, composite logs or other suitable solid fuels are burned to provide localized heating in the dwelling unit and the invention will be described with reference to this application. However, it will be understood that the invention may be employed in various other applications in which so-called afterburner or secondary combustion units have conventionally been employed. More particularly and with reference to FIG. 1 of the drawings, there is illustrated a structural unit 10 having a wall 12 and a roof 14 through which a chimney stack 16 for a wood burning fireplace 18 extends. The fireplace 18 may be of any suitable type and is illustrated as provided with a grate 19 upon which a bundle of wood logs 20 are disposed for ignition. Air for the combustion process may be supplied by air drawn in through an open front of the fireplace or through the sides of the fireplace 18 or through a built up hearth 21.

The chimney stack 16 of the fireplace 18 is provided with a secondary afterburner unit 24 incorporating the present invention. The afterburner unit 24 is connected in the chimney stack 16 by means of suitable connecting collars 26 and 27. Collar 26 is formed at the lower end of a lower inlet conduit 29 which projects into the combustion unit enclosure in a manner as described hereinafter. Collar 27 is formed at an upper conduit 32 in which is located an optional heat recovery section 34 incorporating a heat exchange coil 35 leading to heat evaporator 37, as described in greater detail below.

The combustion unit is provided with conduit 36 forming an interior afterburner chamber 38 which houses a heating element bank 40 comprised of a plurality of heating elements 42. The heating elements 42 preferably are arranged in subsets which can be individually activated. In the embodiment illustrated in FIG. 1, three subsets 44, 45 and 46 are shown with each subset comprising four heating elements. The combustion unit further comprises upper and lower temperature sensors 50 and 51, respectively, which are connected to a control unit 52 for operation of the heating unit as described below. The conduit 29 in the embodiment shown in FIG. 1 is provided with an open upper end about which a baffle system 54 is provided. The controller 52 operates to activate or deactivate the heating elements 42 is response to temperatures measured by the temperature sensors 50 and 51. Heating elements 42 are energized by a suitable electrical power source 56 such as 220 V a.c.

The secondary combustion unit 24 is formed of a steel shell surrounding the tubular members 29 and 36 contained therein and which is lined with a suitable insulation material 57 such as a mineral fiber insulation, for example Durablanket insulation available from Corburundom Co., New York. The tubular member 36 defining the upper conversion chamber 38 is also lined with suitable insulation 57.

When a fire is started in the fireplace 18, the lower temperature sensor 51 generates a signal when the flue temperature reaches a moderately elevated temperature, e.g. a temperature within the range of 100°–150° F. to send a signal to a primary control unit 60 within controller 52. Unit 60 may take the form of a special purpose chip which repeatedly accesses a secondary chip 62 for control of the heating elements to maintain the elements in an on status. In response to an output from chip 60 to the secondary chip 62, the several banks of heating elements are turned on sequentially at time intervals of at least 5 seconds and preferably within the range of 5–15 seconds. Thus, in response to an output signal from the sensor chip 60, the control chip 62 sequentially activates contactors 64, 65 and 66 for the heating element, subsets 44, 45 and 46 at the prescribed time intervals as described above. By sequencing the activation of the heating banks a relatively smooth start up transition is accomplished without undue power surges. The heating elements remain activated and when the temperature reaches a suitable pyrolysis value which typically will be in the range of 1100–1500° F., the chemical conversions leading to the reduce pollutant levels take place. When the temperature exceeds the desired temperature range, the upper temperature sensor 50 responds and generates a signal to controller 52 which triggers the secondary chip 62 to shut down the heating elements 42. The sensor 50 is located immediately above the uppermost heating element or preferably is clamped to the upper heating element. The heating elements 42 may be switched off simultaneously or sequentially in subsets in the same or reverse order from that used to energize the heating unit subsets 44, 45 and 46.

The baffle system 54 is configured to provide a tortuous flow path for the hot combustion gases which results in substantial quantities of particulate material being separated from the flue gas stream. This material drops to the bottom of the combustion unit 24 where it comes to rest on a debris floor 68 which can be exposed to the outside through a door or hatch in the face of the combustion unit 24 to allow accumulated debris to be removed from of the combustion unit.

The baffle system 54 preferably provides first transverse deflecting member 70 which extends substantially transversely across the flue passage 29 so that all or substantially all of the combustion products are directly outwardly. A secondary deflecting element 72 is provided and extends downwardly and outwardly from the primary deflecting member 70. This arrangement forces the combustion products to flow outwardly, thence downwardly and thence upwardly around the top of secondary deflecting member 72 in a manner such that substantial quantities of particulate materials are deflected from the flue gases and settle on the debris floor 68. The deflecting members 70 and 72 normally will be solid, although if desired, small perforations can be provided therein to provide for small jets of gases passing through the deflecting members causing a further turbulence in the area immediately above the baffle system 54.

As described in greater detail below, the baffle system 54 provides for a tortuous flow passage of progressively increasing cross sectional area which results in progressively decreasing flow velocities which aids in the settlement of particulate material from the gaseous combustion product stream.

Figure 2:
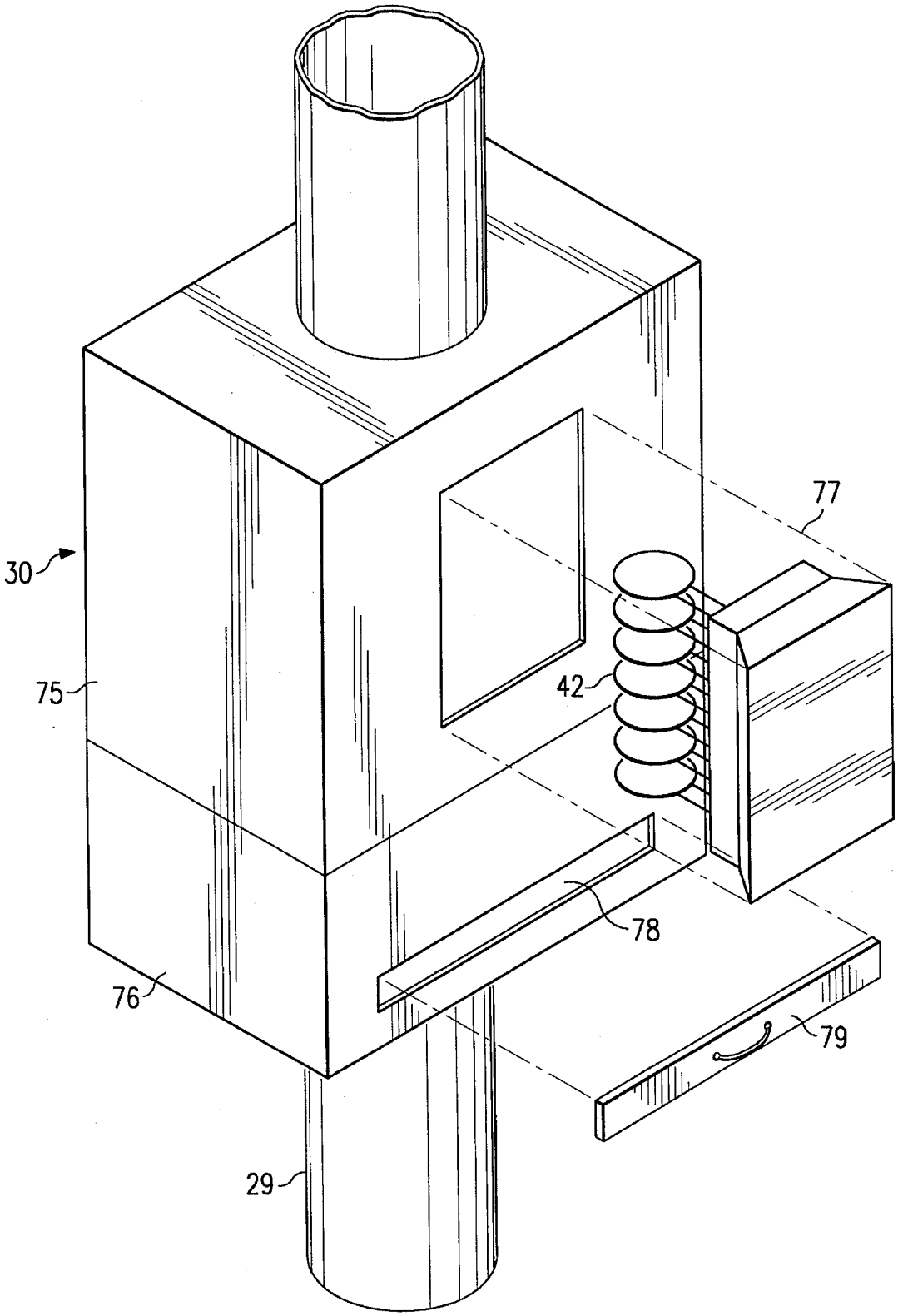
FIG. 2 is a perspective view of a secondary afterburner unit incorporating the present invention showing removal elements for housing a heating bank and providing for the removal of debris from the unit.

Turning now to FIG. 2, there is illustrated a perspective view of the secondary combustion unit which incorporates upper and lower sections 75 and 76. The upper section 75 houses the heating elements 42 in a removable module 77 which can be withdrawn when it is necessary to replace or repair a heating element. The lower section 76 comprises a removable hatch or door 79 which can be withdrawn from a cleanout opening 78 to allow removal of particulate debris from the secondary combustion unit 30. Alternatively, the unit can be provided with a drawer (not shown) having a recess in its bottom panel 80, so that the drawer fits around the tubular conduit 29 extending into the combustion unit 30.

Figure 3:
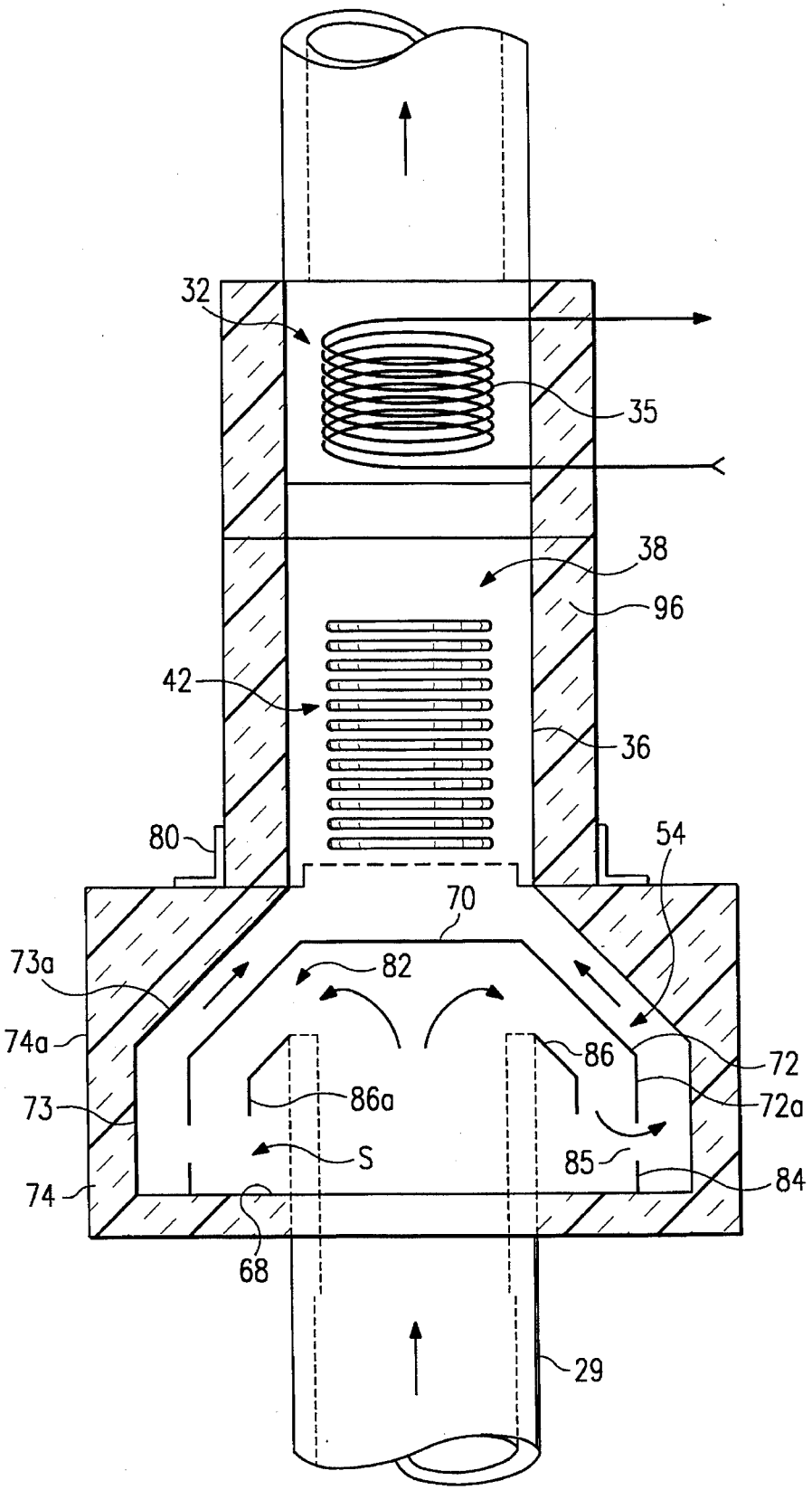
FIG. 3 is a schematic illustration partially in section of a preferred form of secondary heating unit embodying the present invention.

Turning now to FIG. 3, there is illustrated a schematic cross sectional view of a preferred form of the afterburner unit showing details at the preferred baffle system 54 which effectively separates particulate material from the flue gases. As shown in FIG. 3, the lower inlet conduit 29 extends into the interior of the combustion unit enclosure by perhaps 12–15 inches. The transverse primary deflecting member 70 of the baffle 54 is disposed horizontally above the upper end of the conduit 29 and supported there by any suitable means. For example, a plurality of brackets (not shown) may be used to attach the baffle to a transition enclosure 73 included in the lower section 76. The transition enclosure 73 is a generally rectangular member having sloping upper walls **73*a* leading up to the burner section as shown. By way of example, for a 48 inch fireplace, the transition enclosure is about 39 inches wide and 26 inches deep and is surrounded by insulation 74 such as provided by a four inch mineral fiber blanket. The insulation 74 is enclosed within a casing 74*a* which is secured to the burner section casing by means of brackets 80**.

Deflecting member 70 may be of any suitable shape but preferably will be rectangular and centered symmetrically over the conduit 29 and is dimensioned to be somewhat greater than the internal diameter of the inlet conduit 29. For example, in an afterburner unit designed for a 48 inch wood burning fireplace, conduit 29 may take the form of a double walled steel flue pipe having 14 inch O.D. and 11 inch I.D. In this case, deflecting member 70 may take the form of a rectangle positioned generally in a symmetrical relationship over the inlet conduit and spaced above the inlet conduit by about 6 inches to provide a 6 inch lateral outlet opening as indicated by dimension 82.

Where the primary deflecting member 70 is a rectangle, the secondary deflecting member 72 is a rectangular frustum extending at an approximate 45° angle in the cross section shown to a major rectangular dimension of about 27 inches and a transverse minor dimension of 18 inches where it turns downwardly in a rectangular configuration to provide a downwardly projecting rectangular lip portion **72*a*. A rectangular rim 84 extends upwardly from the debris floor of the afterburner unit enclosure to provide a second lateral opening 85 for the egress of combustion products. In the configuration described, the upstanding rim projects upwardly from the debris floor 68 by about 2 inches to provide a lateral opening 85 having a vertical dimension of about 4 inches. An intermediate diffuser 86 is provided which projects outwardly and downwardly from the conduit 29 in a generally conforming relationship with the secondary baffle member 72. The downwardly projecting rectangular lip 86*a* of the diffuser terminates at about the same level as the lower end of the lip portion 72*a* to provide an enlarged settling chamber S where particulate material will settle out of the flue gas. The frustum shaped portion 73*a* of the transition provides a guide member confirming generally in shape to baffle member 72 interposed in the lower portion of the combustion unit forming an enclosure to provide for the flow of combustion products upwardly into the secondary combustion chamber 38 containing the heating elements 42**.

It usually will be preferred to provide the baffle diffuser system with generally rectangular components in order to conform generally to the shape of the combustion unit enclosure 30. However, it is to be recognized that other configurations can be used. For example, the baffle-diffuser system can be configured to provide for generally circular and annular flow passages.

The embodiment illustrated in FIG. 3 with the rim member 84 spaced from the lip portion **72*a* to provide the second lateral opening is particularly advantageous in that it results in the extraction of substantial quantities of particulate material from the combustion affluent. Normally, two separate components are involved in order to provide a peripheral lateral passageway 85 which is open throughout the periphery of the downwardly projecting extending flow passage. However, it will be a recognize that alternative designs can be used in carrying out the invention. For example, the elements 70, 72***a* and 85 can be formed as one unitary stainless steel member with the passageway 85 provided by means of slots cut in the outer rectangular member. While this offers advantages in construction in that the lip and rim members are integrally formed, the turbulent flow resulting from flow through restricted openings is somewhat less advantageous in the configuration shown where passageways of progressively increasing cross sectional areas are employed as described below.

In this respect the baffle system is configured to provide passageways of progressively increasing cross section areas as the combustion effluent passes from the conduit 29 and through the baffle into the secondary into the upper afterburner chamber. This configuration provides for progressive increase and decrease in flow velocity through at least a portion of the baffle system in order to accommodate the extraction of particular materials from the combustion products. In a preferred embodiment of the invention the cross sectional flow passage within the baffle system undergoes at least a two-fold decrease as combustion products exits the mouth of the conduit 29 and pass through the baffle system to flow into the upper afterburner chamber 38.

In the particular embodiment described herein with respect to an 11 inch I.D. conduit the cross sectional area at the mouth of the conduit 29 is about 95 square inches which is increased to a value of about 300 square inches in the outward and downward flow passage defined by the secondary deflecting member 72 and the diffuser. The upward flow passage around the secondary baffle member 72 is further increased in cross sectional area about 700 square inches. The areas of lateral flow passages 82 and 85 are somewhat intermediate of the flow passageways which they interconnect. For example, in the embodiment illustrated in which the primary deflecting member 70 spaced 6 inches above the mouth above the conduit the lateral passageway 82 provide a cross sectional flow area of about 200 square inches. The passageway 85 defined by the lip and rim members 72*a* and 84 has a cross sectional area slightly less than 400 square inches. This configuration of a progressively increasing cross sectional area, with an attendant progressive decrease in flow velocity functions in conjunction with the lip-rim configuration functions to effectively extract particular materials from the combustion air flow, and similarly, the relatively large volume immediately below the diffuser in the baffle generally indicated by reference character S, provides for a transitory decrease of flow velocity before the combustion products pass through the opening 85 and undergo a reversal in direction to flow upwardly through the unit.

The upper afterburner chamber 38 containing the heating element bank is preferably of a somewhat larger cross sectional area than the inlet conduit 29. The heating dement bank 40 in the afterburner chamber 38 can be of any suitable configuration that provides for substantial surface area contact between the heating surfaces and the combustion product effluent. As described above they preferably are arranged in subsets which are sequentially activated to avoid undesirable power surges during operation of the system.

Figure 4:
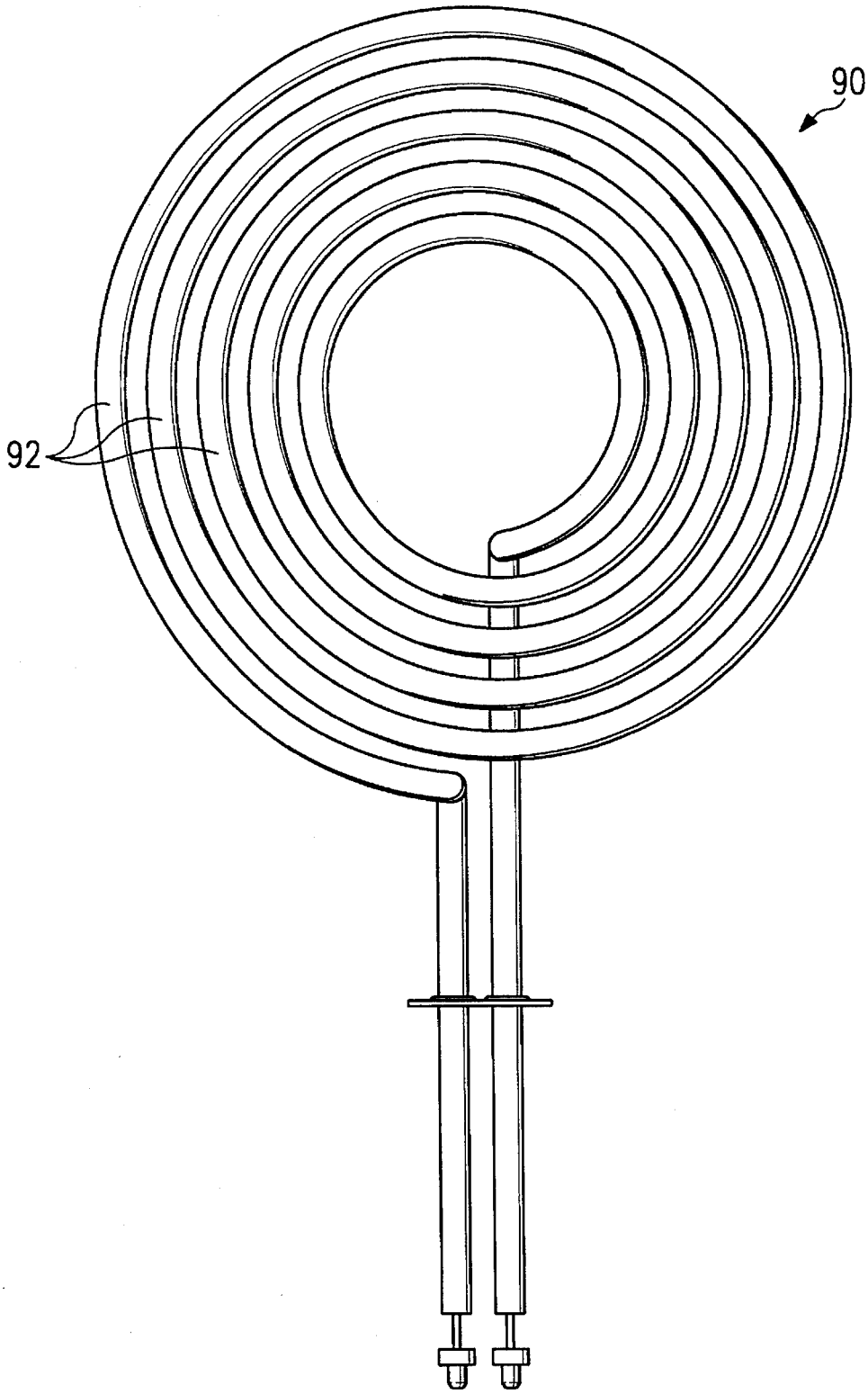
FIG. 4 is a plan view of a heating element incorporated in the invention.

A suitable heating dement for use in the present invention is a 2600 watt, 220 V A.C. element formed in a progressive spiral configuration having an overall diameter of 7 inches such as embodied in element 90 in FIG. 4. There should be sufficient spacing between the coils to prevent gas flow between the coils and of course between the individual heating elements. By reference to FIG. 4, the coils may be of a relatively flat configuration about ¼ inch wide and with air spaces between the adjacent coils as indicated by reference numeral 92 of about ¼ inch. This configuration using 12, 2,600 watt heating coils arranged in three subsets of four each have been found to be effective for a 48 inch wood burning fireplace. In the particular configuration described the individual heating elements are spaced about 3 inches apart so that they occupy about a 30 inch interval of the afterburner chamber 38 (FIG. 3) which in the embodiment illustrated is about 36 inches in length. The 15 inch I.D. conduit 36 within the afterburner chamber can be formed of a steel lined with 4 inches of insulation 94.

As noted previously, the present invention can be employed in conjunction with a heat recovery section which can bolt onto the top of the combustion unit so that it is interposed with the chimney flu. A suitable heat recovery section 32 as disclosed in FIG. 3 and comprises a 16 inch long conduit having an internal diameter of about 15 inches and equipped with a heat exchanger coil 35 formed of about ¾ inch tubing. A suitable heat exchanger medium such as ethylene glycol is circulated through the coil 35 and extends to a secondary evaporative heater 37 as shown in FIG. 1.

It will recognized that a substantial residual content may be present in the combustion effluent as it flows from the afterburner chamber 38 into the heat exchange chamber 32. Some conversion of pollutants thus takes place within the heat recovery chamber 32 as well as the reaction chamber 38. Preferably the residence time within the afterburner chamber 38 is relatively short as noted previously.

Having described specific embodiments of the present invention, it will be understood that modifications thereof may be suggested to those skilled in the art, and it is intended to cover all such modifications as fall within the scope of the appended claims.

What is claimed:

1. In a heating system for use in providing heat within the interior of a structure, the combination comprising:

(a) a primary combustion chamber within said structure and adapted to receive solid combustible fuels such as logs and the like;

(b) a chimney structure extending vertically from said primary combustion chamber and having a flue passageway therein extending from said primary combustion chamber to provide for the flow of gaseous combustion products from said primary combustion chamber to the exterior of said structure;

(c) a heating bank disposed in said flue passage above said primary combustion chamber comprising a plurality of heating elements at longitudinally spaced positions within said flue passage;

(d) a first temperature sensor located below said heating element bank and a second temperature sensor located above said heating element bank;

(e) a baffle system in said flue passage interposed between said heating bank and said primary combustion chamber to deflect the flow of combustion products passing upwardly through said flue passage from said primary combustion chamber from a vertical flow path in a manner to extract particulate materials from said gaseous combustion products; and (f) a control system for said heating elements responsive to signals from said first and second temperature sensors to control the operation of said heating elements.

2. The combination of claim 1, wherein said baffle is interposed between said heating element bank and said lower temperature sensor.

3. The combination of claim 1, wherein said baffle comprises a deflecting member extending transversely throughout the cross sectional area of said flue passage.

4. The combination of claim 3, wherein said deflecting member is configured to deflect combustion products flowing upwardly through said flue passage laterally outwardly about the periphery of said flue passage before returning to vertical flow through said heating elements.

5. The combination of claim 4, wherein said baffle comprises provides a secondary deflecting member which extends downwardly from said transverse deflecting member in said flue passage to direct the lateral flow of combustion products downwardly and thence upwardly to return to a vertical flow configuration through said heating elements.

6. The combination of claim 1 further comprising a control system responsive to signal outputs from said first and second temperature sensors, said control system being responsive to a signal from said first temperature sensor representative of a temperature in excess of normal ambient temperature to generate a signal which activates at least some of said heating elements and being responsive to a signal from said second temperature sensor representative of a second predetermined temperature within a range substantially above said first predetermined temperature for deactivating at least some of said heating elements.

7. The combination of claim 6, wherein the heating elements in said heating bank are arranged in a plurality of heating element subsets and wherein said control system function in response to a signal representative of said first predetermined temperature level to sequentially turn on said subsets in said heating bank at time intervals of at least five seconds.

8. The combination of claim 6, wherein said second predetermined temperature is within the range of 1100°–1500° F.

9. The combination of claim 7, wherein said bank of heating elements extends throughout an interval in said flue passageway of at least two feet.

10. The combination of claim 9, wherein said interval of said flue passageway within which said bank of heating elements is contained is surrounded by an insulator section comprising heat insulating material.

11. The combination of claim 7, wherein said control system function in response to a signal representative of said first predetermined temperature level to sequentially turn on said subsets in said heating bank at time intervals of at least five seconds.

12. In a method for the operation of a fireplace located within a structure and adapted to provide heat within said structure, the steps comprising:

(a) burning a fuel within a primary combustion chamber located within said structure to generate gaseous products of combustion including water, carbon dioxide, carbon monoxide, oxygen and entrained particulate material;

(b) withdrawing said combustion products from said primary combustion chamber through a confined flue passageway extending upwardly from the primary combustion chamber to the exterior of said structure;

(c) interrupting the vertical flow of said combustion products within said flue passageway to cause said combustion products to follow a tortuous path in which said entrained particulate material within said gaseous combustion products is separated from said gaseous combustion products and thereafter flowing said combustion products through a secondary afterburner section of said flue passageway having a heating bank comprising a plurality of heating elements therein;

(d) sensing the temperature of said combustion products at a first location below said afterburner section and a second location located above said heating bank;

(e) activating said heating elements when the temperature at said first location reaches a specified value in excess of ambient temperature conditions;

(f) heating said combustion products by said temperature heating elements to a temperature sufficient to convert carbon monoxide in said combustion products to carbon dioxide;

(g) in response to the temperature at the second location reaching a specified value above that required for the conversion of carbon monoxide to carbon dioxide, deenergizing at least some of heating elements.

13. The method of claim 12, wherein said heating elements are arranged in a plurality of subsets and further comprising the step of sequentially activating said subsets of heating elements in response to said first temperature valve at intervals of at least five seconds.

14. The method of claim 13, wherein said subsets of heating elements are activated at intervals within the range of 5–15 seconds.

15. The method of claim 13, wherein said combustion products follow a peripherally outwardly flow path from said flue passageway and thence downwardly and thence peripherally upwardly from said downward path into contact with said heating elements.

16. The method of claim 15, wherein the residence time of said combustion products within said heating bank is within the range of 0.5–2.0 seconds.

17. In a secondary afterburner for reducing the pollutant level of flue gas resulting from the operation of a primary combustion unit such as a fireplace or the like, the combination comprising:

(a) a combustion unit enclosure having an interior passageway therein adapted to be inserted into the flue passage of a chimney structure and having an inlet and an outlet;

(b) a heating bank comprising a plurality of heating elements disposed at longitudinally spaced positions along said interior and located in an upper portion of said unit;

(c) a baffle section in said flow passage located below said bank of heating elements and having a deflecting member extending transversely across said flue passage to intersect the flow of combustion products from the inlet of said section and prevent direct flow of such products to said heating elements;

(d) said heating elements being arranged in subsets of two or more heating elements, each subset being connected to an electrical contactor whereby said subsets of heating elements may be individually activated;

(e) a control system for activating said heating elements;

(f) a temperature sensor in said unit above said heating elements for generating a signal which can be used to deactivate said heating elements upon the detection of a predetermined high temperature level by said temperature sensor.

18. The combination of claim 16, wherein the lower section of said container includes a removable clean out hatch for removing particulate material from said unit.

19. In a secondary afterburner for reducing the pollutant level of flue gas resulting from the operation of primary combustion unit such as a fireplace or the like, the combination comprising:

(a) a combustion unit enclosure having an interior afterburner chamber in an upper portion thereof and a debris floor in a lower portion thereof for the collection of debris from combustion products therein;

(b) a lower inlet and an upper outlet in fluid communication with said afterburner passageway and adapted to be inserted in the flue passage of a chimney structure so as to provide fluid communication between said chimney flue and said interior passageway;

(c) a conduit at said inlet extending into an opening into the interior of said combustion unit enclosure;

(d) a transverse deflecting member within said combustion unit enclosure above said inlet conduit and defining with said conduit a lateral opening providing a flow passage for the lateral flow of combustion products flowing upwardly through said conduit;

(e) a secondary deflecting member which extends downwardly and outwardly from said primary deflecting member and terminating in a downward projecting lip portion;

(f) an upstanding rim projecting upwardly from the debris floor of said combustion unit and terminating at a location to provide with said lip portion, a second lateral opening for the egress of combustion products flowing laterally through said opening and thence upwardly to said afterburner passageway.

20. The combination of claim 19 further comprising an intermediate wall member projecting outwardly and downwardly from said conduit and interposed between said conduit and said secondary deflecting member and defining with said second baffle deflecting member, a flow passage for the flow of combustion products emanating from said tube laterally and downwardly and thence upwardly around said first recited downwardly projecting lip member.

21. In a secondary afterburner for reducing the pollutant level of flue gas resulting from the operation of primary combustion unit such as a fireplace or the like, the combination comprising:

(a) a combustion unit enclosure having an interior afterburner chamber in an upper portion thereof and a debris floor in a lower portion thereof for the collection of debris from combustion products therein;

(b) a lower inlet and an upper outlet in fluid communication with said afterburner passageway and adapted to be inserted in the flue passage of a chimney structure so as to provide fluid communication between said chimney flue and said interior passageway;

(c) a conduit at said inlet extending into an opening into the interior of said combustion unit enclosure;

(d) a baffle system providing a tortuous flow passageway between the outlet of said conduit and said afterburner chamber and configured to provide a lateral flow passage leading to a downward flow passage of greater cross-sectional area than said conduit and a second lateral flow passage leading to an upper flow passage opening into said afterburner chamber and having a greater cross-sectional area than said downward flow passage.

22. The combination of claim 21 in which said second lateral passage has a cross-sectional area immediate the cross-sectional areas of said downward flow passage and said upward flow passage.

23. The combination of claim 21 further comprising a heating bank disposed in said afterburner chamber and comprising a plurality of heating elements at longitudinally spaced positions within said afterburner chamber.

24. The combination of claim 23 further comprising a first temperature sensor located below said heating element bank and a second temperature sensor located above said heating dement bank and a control system responsive to signals from said first and second temperature sensing signals to control the operation of said heating elements.

25. The combination of claim 24 further comprising a control system responsive to signal outputs from said first and second temperature sensors, said control system being responsive to a signal from said first temperature sensor representative of a temperature in excess of normal ambient temperature to generate a signal which activates at least some of said heating elements and being responsive to a signal from said second temperature sensor representative of a second predetermined temperature within a range substantially above said first predetermined temperature for deactivating at least some of said heating elements.

26. The combination of claim 23 further comprising a heat recovery chamber above and in fluid communication with said afterburner chamber and having an indirect heat exchanger therein.

* * * * *